US009069296B2

(12) United States Patent
Aritaki et al.

(10) Patent No.: US 9,069,296 B2
(45) Date of Patent: Jun. 30, 2015

(54) HEATER

(75) Inventors: Yasuyuki Aritaki, Kyoto (JP); Shinobu Obata, Kyoto (JP); Teruhisa Sako, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 525 days.

(21) Appl. No.: 12/527,098

(22) PCT Filed: Feb. 14, 2008

(86) PCT No.: PCT/JP2008/052433

§ 371 (c)(1),
(2), (4) Date: Aug. 13, 2009

(87) PCT Pub. No.: WO2008/102688

PCT Pub. Date: Aug. 28, 2008

(65) Prior Publication Data

US 2010/0038355 A1 Feb. 18, 2010

(30) Foreign Application Priority Data

Feb. 19, 2007 (JP) ..... 2007-038083

(51) Int. Cl.

| | |
|---|---|
| ***H05B 1/00*** | (2006.01) |
| ***H05B 3/00*** | (2006.01) |
| ***H05B 11/00*** | (2006.01) |
| ***G03G 15/20*** | (2006.01) |
| ***H05B 3/26*** | (2006.01) |
| ***H05B 3/28*** | (2006.01) |

(52) U.S. Cl.

CPC ..... *G03G 15/2003* (2013.01); *H05B 3/00* (2013.01); *G03G 15/2064* (2013.01); *H05B 3/26* (2013.01); *H05B 3/28* (2013.01); *H05B 2203/017* (2013.01)

(58) Field of Classification Search

CPC ..... Y10T 29/49083; Y10T 29/49087; H05B 3/146; H05B 3/16; H05B 3/00; H05B 2203/017; G03G 15/2064

USPC ..... 219/548, 546, 201, 216; 29/611; 399/329

See application file for complete search history.

(56) References Cited

U.S. PATENT DOCUMENTS

| | | | | |
|---|---|---|---|---|
| 5,379,017 A * | 1/1995 | Katsuno | ..... | 338/332 |
| 6,535,106 B2 * | 3/2003 | Teramae | ..... | 338/309 |

FOREIGN PATENT DOCUMENTS

| | | | | |
|---|---|---|---|---|
| JP | 2002-75599 | | 3/2002 | |
| JP | 2002075599 A | * | 3/2002 | ..... H05B 3/16 |
| JP | 2002-108120 | | 4/2002 | |
| JP | 2002108120 A | * | 4/2002 | ..... G03G 15/20 |
| JP | 2002-289328 | | 10/2002 | |
| JP | 2002289328 A | * | 10/2002 | ..... H05B 3/18 |
| JP | 2003109727 A | * | 4/2003 | ..... H05B 3/20 |
| JP | 2004006289 A | * | 1/2004 | ..... H05B 3/16 |
| JP | 2006-351366 | | 12/2006 | |
| JP | 2006351366 A | * | 12/2006 | |

* cited by examiner

*Primary Examiner* — Dana Ross
*Assistant Examiner* — Hemant Mathew
(74) *Attorney, Agent, or Firm* — Hamre, Schumann, Mueller & Larson, P.C.

(57) ABSTRACT

A heater (A1) includes a substrate (1), a heating resistor (2) formed on the substrate (1) and a protective film (3) covering the heating resistor (2). The protective film (3) includes a crystallized glass layer (31) and an amorphous glass layer (33) covering the crystallized glass layer (31). The protective film (3) further includes a semi-crystalline glass layer (32) surrounding an edge (31*a*) of the crystallized glass layer (32). The semi-crystalline glass layer (32) intervenes between the substrate (1) and a portion of the amorphous glass layer (33) that projects relative to the crystallized glass layer (31).

7 Claims, 3 Drawing Sheets

HEATER

TECHNICAL FIELD

The present invention relates to a heater used in e.g. a laser printer to thermally fix toner transferred to recording paper.

BACKGROUND ART

Conventionally, various types of heaters have been proposed (see e.g. Patent Document 1). FIG. 5 shows an example of conventional heater. The heater X illustrated in the figure includes a substrate 91, a heating resistor 92 and a protective film 93. The protective film 93 is for protecting the heating resistor 92 and made up of an inner layer 93*a* and an outer layer 93*b*. The inner layer 93*a* is made of crystallized glass and held in contact with the heating resistor 92. The outer layer 93*b* is made of amorphous glass and covers the inner layer 93*a*. The inner layer 93*a* prevents the heating resistor 92 from being unduly in electrical connection with a conductive part outside the heater X. By making the inner layer 93*a* using crystallized glass, the withstand voltage of the inner layer (and hence the protective film 93) is enhanced. By making the outer layer 93*b* using amorphous glass, the obverse surface of the protective film 93 is made smooth.

However, in the conventional structure, the edge of the outer layer 93*b* made of amorphous glass is held in contact with the upper surface of the substrate 91. Generally, amorphous glass easily form bubbles by reacting with e.g. AlN. Thus, when the substrate is made of AlN in the conventional structure, bubbles may be formed at the edge of the outer layer 93*b*. The formation of bubbles undesirably reduces the withstand voltage of the protective film 93. Further, moisture in the air is easily absorbed in the inner layer 93*a* through the portion of the outer layer 93*b* in which bubbles are formed. The absorption of moisture may cause such a problem as local expansion of the inner layer 93*a*.

Patent Document 1: JP-A-2002-289328

DISCLOSURE OF THE INVENTION

The present invention has been proposed under the circumstances described above. It is, therefore, an object of the present invention to provide a heater which is capable of preventing a reduction in the withstand voltage of the protective film and moisture absorption in the protective film.

A heater provided according to the present invention includes a substrate, a heating resistor formed on the substrate, and a protective film including a crystallized glass layer covering the heating resistor and an amorphous glass layer covering the crystallized glass layer. The protective film further includes a semi-crystalline glass layer surrounding an edge of the crystallized glass layer and intervening between the substrate and a portion of the amorphous glass layer that projects from the crystallized glass layer.

Preferably, the substrate includes a rectangular upper surface that is elongate in one direction, and the heating resistor includes two main portions extending in parallel to each other in the longitudinal direction of the rectangular upper surface and a connection portion connecting the two main portions to each other.

Preferably, the crystallized glass layer includes a first layer held in direct contact with the heating resistor and a second layer covering the first layer. An additional semi-crystalline glass layer that is elongate in a direction in which the main portions of the heating resistor extend is provided between the first layer and the second layer.

Other features and advantages of the present invention will become more apparent from the detailed description given below with reference to the accompanying drawings.

BEST MODE FOR CARRYING OUT THE INVENTION

Preferred embodiments of the present invention will be described below with reference to the accompanying drawings.

Figure 1:
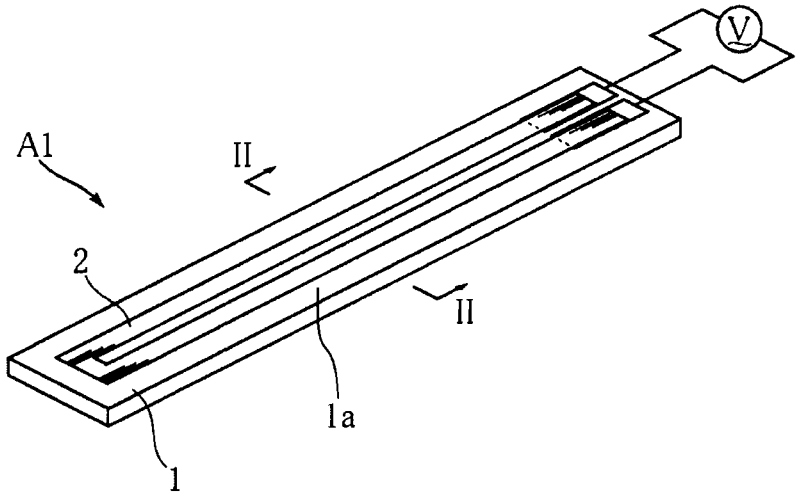
FIG. 1 is a perspective view showing a heater according to a first embodiment of the present invention.
Figure 2:
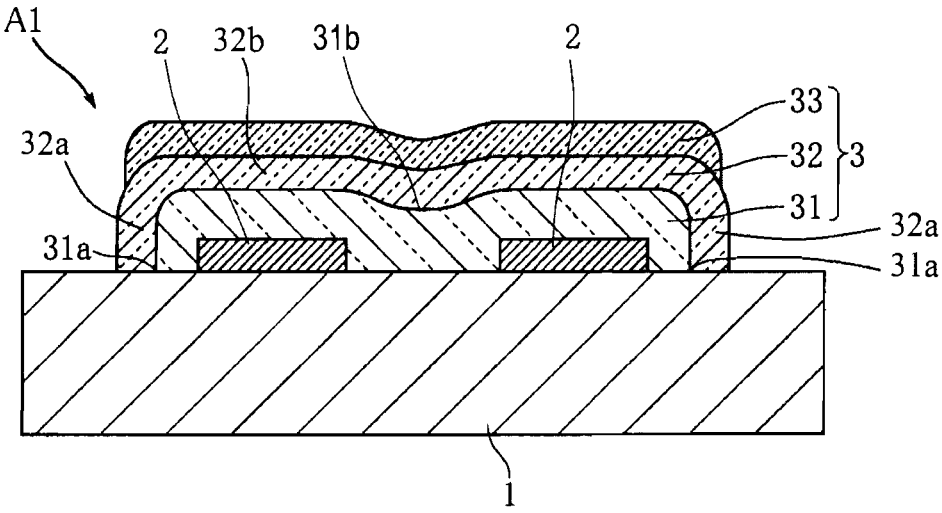
FIG. 2 is a sectional view taken along lines II-II in FIG. 1.

FIGS. 1 and 2 show a heater according to a first embodiment of the present invention. The illustrated heater A1 includes a substrate 1, a heating resistor 2 and a protective film 3. The heater A1 is used in e.g. a laser printer to thermally fix toner transferred to recording paper. For easier understanding, the illustration of the protective film 3 is omitted in FIG. 1.

The substrate 1 is in the form of an elongated rectangle and made of an insulating material. Examples of the insulating material include AlN and $Al_2O_3$.

The heating resistor 2 is formed on the substrate 1 and entirely U-shaped, as shown in FIG. 1. Specifically, the heating resistor 2 includes two main portions extending in parallel to each other in the longitudinal direction of the upper surface 1*a* of the substrate 1, and a connection portion connecting the two main portions. The heating resistor 2 is made of a resistive material containing Ag—Pd. The proportion by weight of Pd is e.g. 50 to 60%.

The protective film 3 is provided for protecting the heating resistor 2 and made up of a crystallized glass layer 31, a semi-crystalline glass layer 32 and an amorphous glass layer 33.

The crystallized glass layer 31 is made of crystallized glass such as SiO2-BaO—Al2O3-ZnO-based glass and held in contact with the heating resistor 2. The crystallized glass layer 31 has a thickness of e.g. about 60 μm, and having an upper surface provided with a recess 31*b*.

The semi-crystalline glass layer 32 is made of semi-crystalline glass such as BaO—SiO2-based glass and covers the entirety of the crystallized glass layer 31. Thus, the edge 31*a* of the crystallized glass layer 31 (periphery of the surface held in contact with the substrate 1) is surrounded by the upright portion 32*a* of the semi-crystalline glass layer 32. The semi-crystalline glass layer 32 has a thickness of e.g. about 20 μm.

The amorphous glass layer 33 is made of amorphous glass such as SiO2-ZnO—MgO-based glass and formed on the semi-crystalline glass layer 32. The amorphous glass layer 33 has a thickness of e.g. about 20 μm. In this embodiment, the amorphous glass layer 33 covers only the upper surface and the nearby portion of the semi-crystalline glass layer 32 and does not cover the side surfaces of the semi-crystalline glass layer 32. Specifically, as shown in FIG. 2, the amorphous glass layer 33 includes portions projecting laterally from the crystallized glass layer 31, the semi-crystalline glass layer 32 includes a horizontal portion 32*b*, and each of side portions (upright portions 32*a*) of the semi-crystalline glass layer 32 intervenes between one of the projecting portions and the substrate 1.

The advantages of the heater A1 will be described below.

With the above-described arrangement, the amorphous glass layer 33 is entirely spaced from the substrate 1 and does not include a portion held in contact with the substrate. As compared with an amorphous glass layer, the semi-crystalline glass layer 32 does not easily form bubbles even when it is in contact with AlN forming the substrate 1. Thus, the formation of bubbles in the protective film 3 is suppressed, so that the withstand voltage of the entire protective film 93 is prevented from reducing.

Moreover, by suppressing the formation of bubbles at the protective film 3, air is substantially prevented from entering the crystallized glass layer 31. As a result, the crystallized glass layer 31 is prevented from locally expanding due to the moisture in the air.

Figure 3:
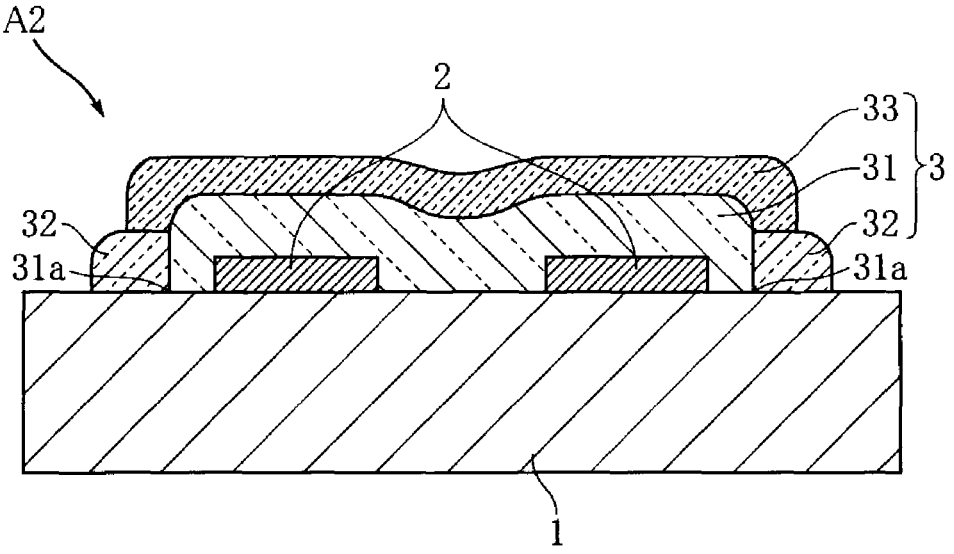
FIG. 3 is a sectional view showing a heater according to a second embodiment of the present invention.
Figure 4:
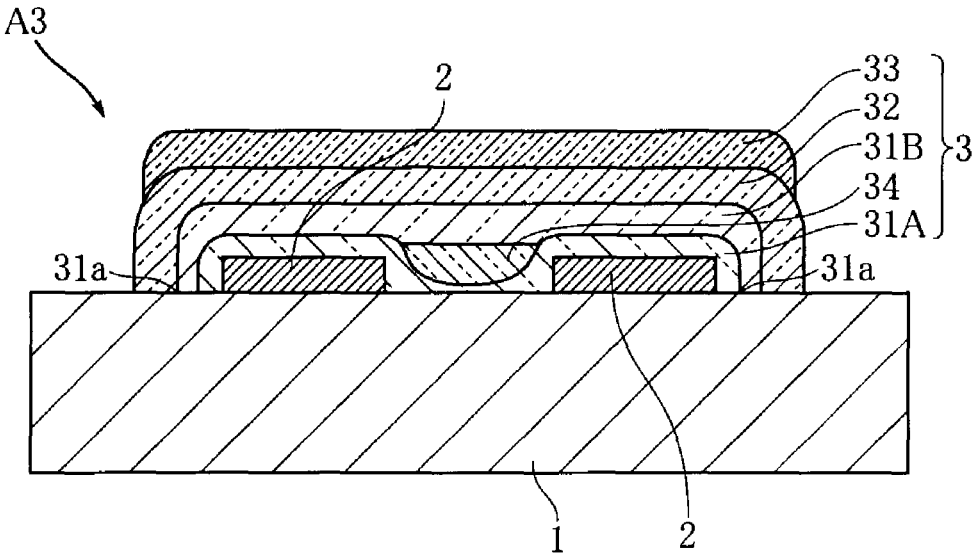
FIG. 4 is a sectional view showing a heater according to a third embodiment of the present invention.
Figure 5:
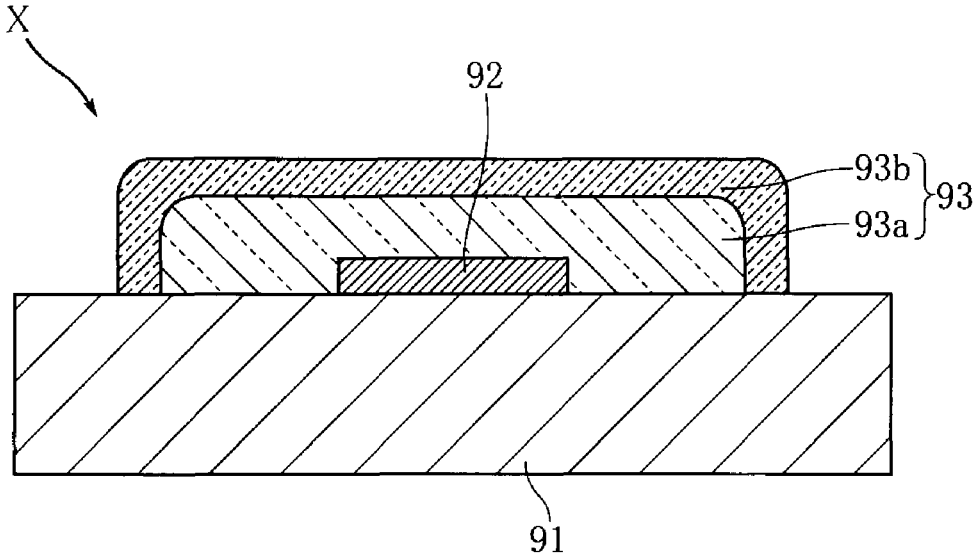
FIG.5 PRIOR ART
FIG. 5 is a sectional view showing an example of conventional heater.

FIGS. 3 and 4 show other embodiments of the present invention. In these figures, the elements which are identical or similar to those of the first embodiment are designated by the same reference signs as those used for the first embodiment.

FIG. 3 is a sectional view showing a heater according to a second embodiment of the present invention. The illustrated heater A2 is different from that of the first embodiment in shape of the semi-crystalline glass layer 32. In the second embodiment, the semi-crystalline glass layer 32 is in the form of a frame which covers only part of the crystallized glass layer 31 and does not cover the entirety of the crystallized glass layer 31. Specifically, in the heater A2, the semi-crystalline glass layer 32 intervenes between the substrate 1 and a portion of the amorphous glass layer 33 which projects laterally from the crystallized glass layer 31. Thus, the crystallized glass layer 31 and the amorphous glass layer 33 are held in direct contact with each other at portions where they overlap each other. With this arrangement again, the formation of bubbles at the protective film 3 is prevented.

FIG. 4 shows a heater according to a third embodiment of the present invention. The illustrated heater A3 is different from those of the first and the second embodiments in structure of the protective film 3. The protective film 3 of the heater A3 is made up of crystallized glass layers 31A, 31B, a semi-crystalline glass layer 32, an amorphous glass layer 33 and a semi-crystalline glass layer 34. The heating resistor 2 is directly covered by the crystallized glass layer 31A. The crystallized glass layers 31A and 31B are made of crystallized glass and laminated on the substrate 1 in the mentioned order. The semi-crystalline glass layer 34 is provided between the crystallized glass layers 31A and 31B. The semi-crystalline glass layer 34 is elongate in the direction in which the two main portions of the heating resistor 2 extend and arranged between the two main portions. The semi-crystalline glass layer 34 is made of the same semi-crystalline glass as that forming the semi-crystalline glass layer 32. With this arrangement again, the formation of bubbles at the protective film 3 is prevented. Further, the provision of the semi-crystalline glass layer 34 enhances the withstand voltage between the portions of the heating resistor 2 which extend in parallel to each other.

The invention claimed is:

1. A heater comprising:

a substrate including an upper surface that is rectangular and elongate in a longitudinal direction;

a heating resistor formed on the upper surface of the substrate; and a protective film including a crystallized glass layer covering the heating resistor, and an amorphous glass layer covering the crystallized glass layer, the crystallized glass layer being held in direct contact with the upper surface of the substrate, the amorphous glass layer as a whole being spaced apart from the upper surface of the substrate;

wherein the protective film further includes a semi-crystalline glass layer in addition to the crystallized glass layer and the amorphous glass layer, the semi-crystalline glass layer intervening between the substrate and a portion of the amorphous glass layer that projects from the crystallized glass layer, the semi-crystalline glass layer having an end that is adjacent to the crystallized glass layer and held in direct contact with the upper surface of the substrate, wherein the heating resistor comprises two main portions extending in parallel to each other in the longitudinal direction of the upper surface of the substrate, and a connection portion connecting the two main portions to each other, and the crystallized glass layer comprises an upper surface formed with a recess corresponding in position to a location between the two main portions of the heating resistor, the recess being spaced apart from the upper surface of the substrate.

2. The heater according to claim 1, wherein the crystallized glass layer includes a first layer held in direct contact with the heating resistor, and a second layer covering the first layer, the recess being formed in the first layer, and an additional semi-crystalline glass layer is provided between the first layer and the second layer, the additional semi-crystalline glass layer being elongate in a direction in which the main portions of the heating resistor extend.

3. The heater according to claim 1, wherein the substrate is made of one of AlN and $Al_2O_3$.

4. The heater according to claim 1, wherein the semi-crystalline glass layer extends upward beyond the two main portions of the heating resistor.

5. The heater according to claim 2, wherein the additional semi-crystalline glass layer is disposed in the recess.

6. The heater according to claim 1, wherein the semi-crystalline glass layer is held in direct contact with each of the crystallized glass layer, the amorphous glass layer and the upper surface of the substrate.

7. The heater according to claim 5, wherein the entirety of the additional semi-crystalline glass layer is arranged within the recess, and the recess is sealed by the second layer.

* * * * *